US008460068B2

(12) United States Patent
Chou

(10) Patent No.: US 8,460,068 B2
(45) Date of Patent: Jun. 11, 2013

(54) DISC SANDER

(76) Inventor: Calvin Chou, Taichung Hsieng (TW)

( * ) Notice: Subject to any disclaimer, the term of this patent is extended or adjusted under 35 U.S.C. 154(b) by 335 days.

(21) Appl. No.: 13/007,184

(22) Filed: Jan. 14, 2011

(65) Prior Publication Data

US 2012/0184188 A1 Jul. 19, 2012

(51) Int. Cl.
*B24B 23/00* (2006.01)
*B24B 7/00* (2006.01)

(52) U.S. Cl.
USPC ..... 451/359; 451/280; 451/282; 451/414

(58) Field of Classification Search
USPC ..... 451/174, 280, 282, 359, 414, 451
See application file for complete search history.

(56) References Cited

U.S. PATENT DOCUMENTS 3,894,358 A * 7/1975 Lorenz ..... 451/72
4,924,633 A * 5/1990 Hock et al. ..... 451/303
5,074,079 A * 12/1991 Park ..... 451/11
5,159,786 A * 11/1992 Amundsen ..... 451/28
5,199,220 A * 4/1993 Steiner et al. ..... 451/65
D341,844 S * 11/1993 Arehart ..... D15/124
5,337,522 A * 8/1994 Chien ..... 451/414
D355,201 S * 2/1995 Brickner, Jr. ..... D15/125
6,095,906 A * 8/2000 Wang ..... 451/65
6,139,411 A * 10/2000 Everts et al. ..... 451/359
6,761,623 B1 * 7/2004 Baker ..... 451/280

* cited by examiner

*Primary Examiner* — Eileen P. Morgan
(74) *Attorney, Agent, or Firm* — WPAT, P.C.; Anthony King

(57) ABSTRACT

A disc sander includes a housing having an operation platform for holding a workpiece on a work surface at the operation platform for sanding, a sanding mechanism pivotally mounted on the housing and having a sanding surface for sanding the workpiece, and an angle adjustment unit set between the housing and the sanding mechanism and including two swing plates disposed at two opposite lateral sides relative to the housing and respectively connected to the sanding mechanism so that the sanding mechanism is biasable with the swing plates relative to the housing to change the angle between the work surface and the sanding surface.

9 Claims, 6 Drawing Sheets

DISC SANDER

BACKGROUND OF THE INVENTION

1. Field of the Invention

The present invention relates to a sanding machine for polishing the surface of a metal or wood workpiece and more particularly, to a disc sander, which allows biasing of the sanding mechanism to adjust the angle between the sanding mechanism and the operation platform.

2. Description of the Related Art

A disc sander is adapted for polishing the surface of a metal or wood workpiece. A conventional disc sander generally comprises a housing, a motor mounted in the housing, an operation platform mounted on the housing and adapted for holding a workpiece for sanding, and a sanding wheel rotatable by the motor to sand the workpiece at the operation platform.

Before sanding the workpiece, the angle between the operation platform and the sanding wheel must be adjusted subject to the angle of the surface of the workpiece to be polished so that the surface of the workpiece can be kept in positive contact with the sanding wheel for sanding. Therefore, a conventional disc sander includes an angle adjustment unit for allowing adjustment of the tilting angle of the operation platform relative to the sanding wheel. When sanding the workpiece, the operator must hold the workpiece and push the workpiece into contact with the sanding surface of the sanding wheel. However, because the operation platform is kept in a tilted position, the operator must apply much force to the workpiece against the sanding surface of the sanding wheel, avoiding sliding of the workpiece on the operation platform. When sanding a big size workpiece, it is difficult to hold the heavy workpiece on the tilted operation platform against the sanding surface of the sanding wheel. If the workpiece slides accidentally during sanding, the sanding quality will be affected.

SUMMARY OF THE INVENTION

The present invention has been accomplished under the circumstances in view. It is one object of the present invention to provide a disc sander, which eliminates the labor-wasting drawback of the prior art design that allows adjustment of the angle between the sanding wheel and the operation platform by means of changing the tilting angle of the operation platform and cannot prohibit sliding of a heavy workpiece to affect the sanding quality during the sanding operation.

To achieve this and other objects of the present invention, a disc sander comprises a housing having a fixed operation platform, the operation platform having a work surface for holding a workpiece for sanding, a sanding mechanism pivotally mounted on the housing and having a sanding surface for sanding the workpiece, and an angle adjustment unit set between the housing and the sanding mechanism and including two swing plates disposed at two opposite lateral sides relative to the housing and respectively connected to the sanding mechanism so that the sanding mechanism is biasable with the swing plates relative to the housing to change the angle between the work surface and the sanding surface.

By means of biasing the sanding mechanism to change the angle between the work surface and the sanding surface without changing the angle of the operation platform, the workpiece will not slide on the work surface of the operation platform during sanding, and therefore the operator can force the workpiece into positive contact with the sanding surface of the sanding mechanism with less effort, assuring high sanding efficiency and high sanding quality.

Further, a positioning device is mounted in a mounting plate at each of two opposite lateral sides of the housing for controlling positioning of one respective swing plate relative to the housing.

Further, each swing plate has an arched adjustment slot for the passing of an axle that is transversely mounted in two parallel mounting plates at the housing, and a toothed portion extending along at least one of two opposite lateral sides of the arched adjustment slot. Further, two gears are mounted on the axle and respectively meshed with the toothed portions of the swing plates. Thus, rotating the axle causes biasing of the swing plates and the sanding mechanism relative to the housing to change the angle between the work surface and the sanding surface.

DETAILED DESCRIPTION OF THE PREFERRED EMBODIMENT

The spirit and scope of the invention will be fully understood by way of embodiments by reference to the following specification in conjunction with the annexed drawings, in which every component part is illustrated subject to a proper proportion, size, deformation or displacement, and like reference signs denote like elements of structure.

Figure 1:
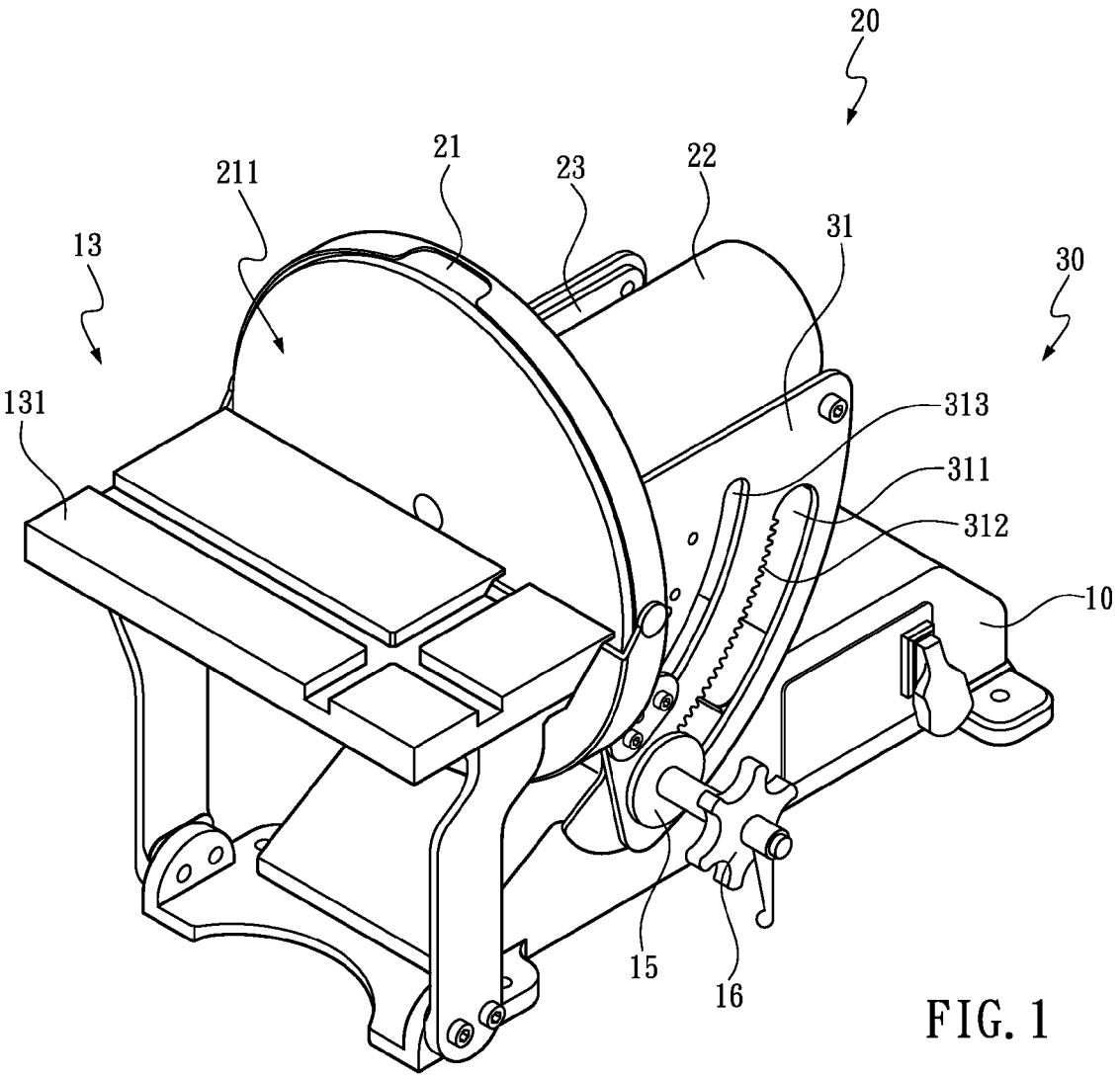
FIG. 1 is an oblique elevational view of a disc sander in accordance with the present invention.
Figure 2:
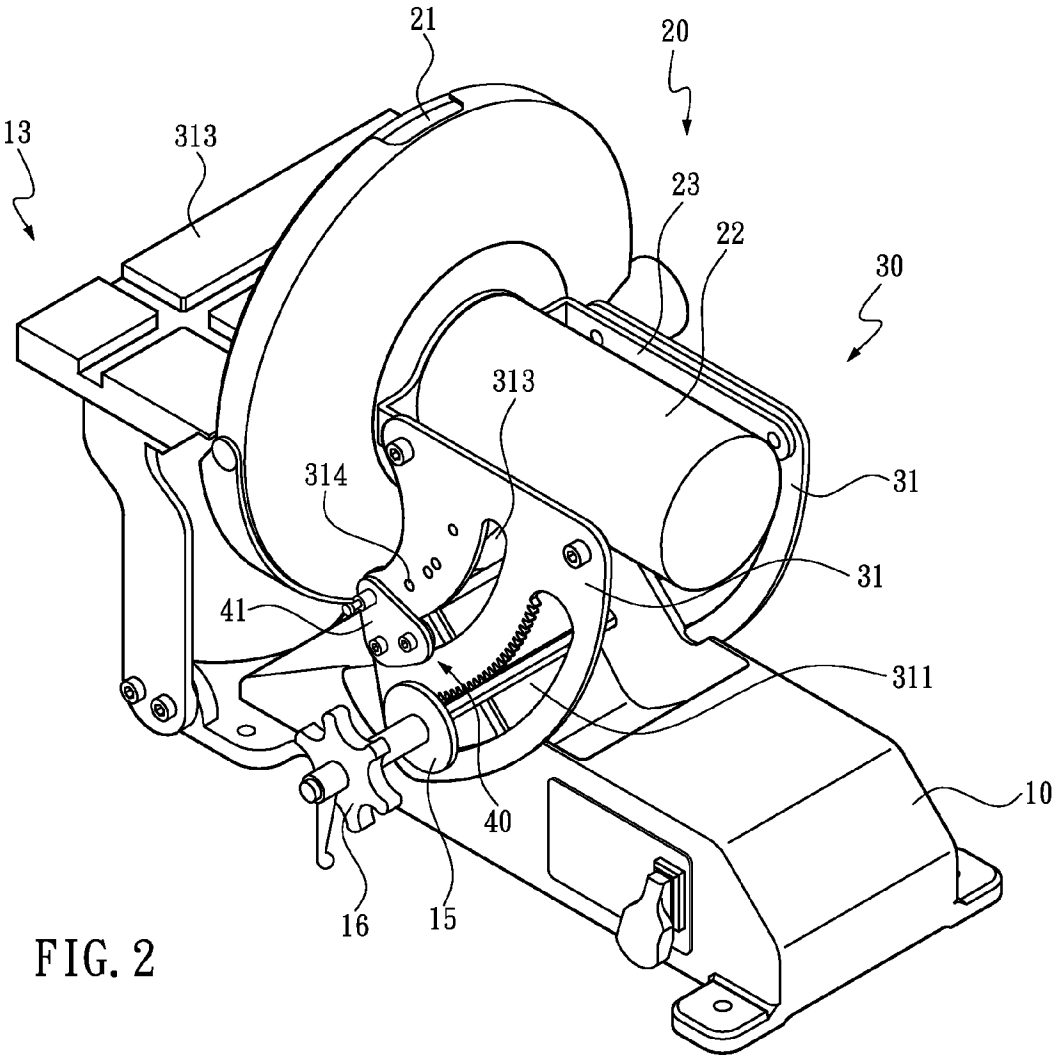
FIG. 2 corresponds to FIG. 1 when viewed from another angle.
Figure 3:
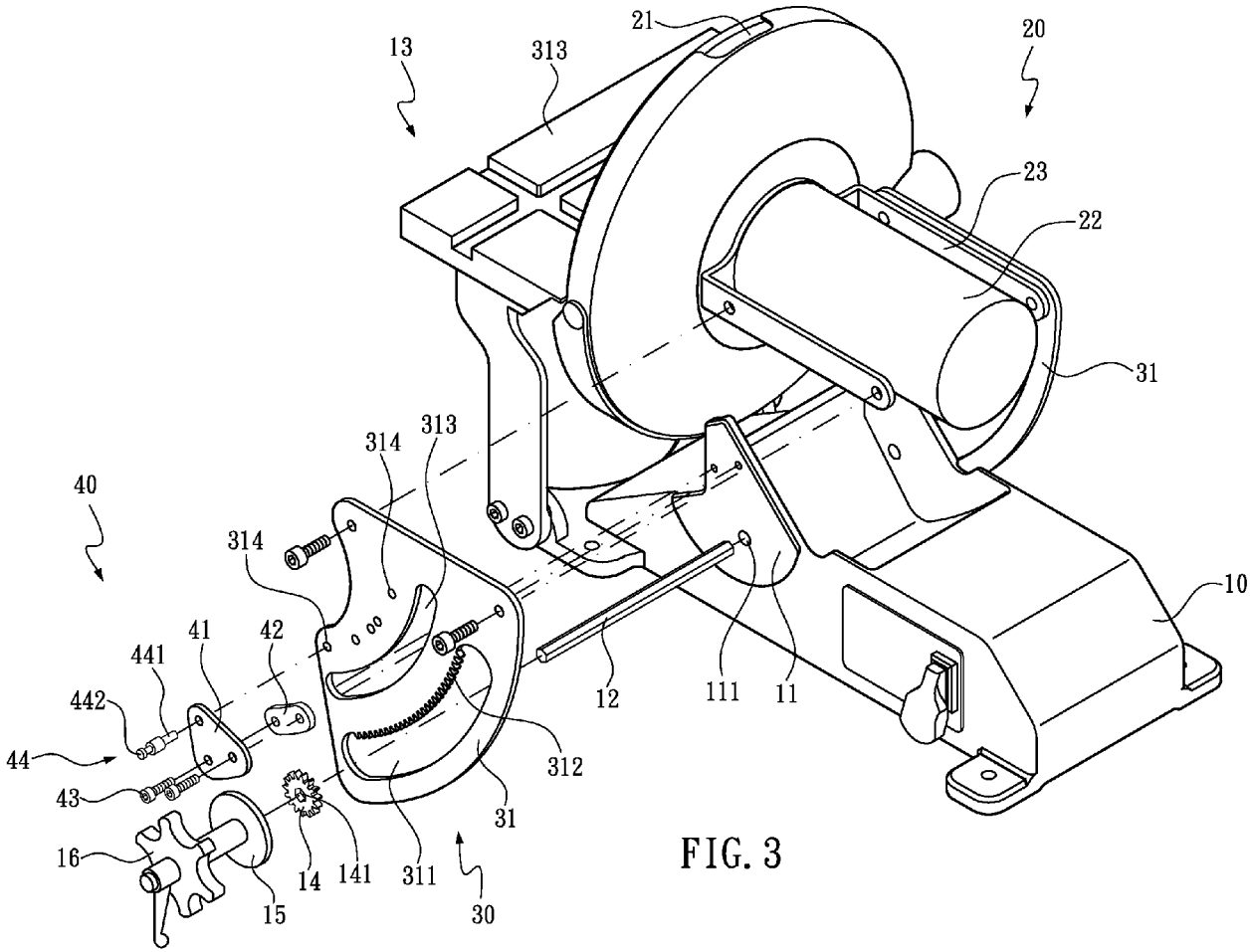
FIG. 3 is an exploded view of the disc sander in accordance with the present invention.

Referring to FIGS. 1-3, a disc sander in accordance with the present invention is shown comprising a housing 10, a sanding mechanism 20, an angle adjustment unit 30 and two positioning devices 40.

The housing 10 comprises two mounting plates 11 symmetrically disposed at two opposite lateral sides thereof, each mounting plate 11 having a through hole 111 cut through two opposite sides thereof, a noncircular axle, for example, a hexagonal axle 12 mounted in the through holes 111 of the mounting plates 11, and an operation platform 13 located on the front side thereof. The operation platform 13 provides a work surface 131 for holding a metal or wood workpiece for sanding. Further, the operation platform 13 is detachably fastened to the housing 10.

The sanding mechanism 20 comprises a sand wheel 21, a motor 22 and a bracket 23. The sanding mechanism 20 is pivotally mounted on the top side of the housing 10. The sand wheel 21 has a sanding surface 211 facing the work surface 131 of the operation platform 13 for sanding the workpiece. The bracket 23 is disposed at two opposite lateral sides relative to the motor 22.

The angle adjustment unit 30 consists of two swing plates 31. The two swing plates 31 are respectively affixed to the bracket 23 of the sanding mechanism 20 and disposed at the two opposite lateral sides of the housing 10. Each swing plate 31 has an arched adjustment slot 311 that is made subject to the sanding mechanism 20 as the center and the distance between the sanding mechanism 20 and each swing plate 31 as the radius and adapted for the passing of the axle 12, and a toothed portion 312 extending along at least one of the two opposite lateral sides of the arched adjustment slot 311. Further, two gears 14 are respectively mounted on the axle 12 and meshed with the toothed portions 312 of the swing plates 31 of the angle adjustment unit 30. Each gear 14 has a noncircular center axle hole 141 that fits the cross section of the axle 12. Thus, the gears 14 are rotatable with the axle 12. Further, two stop members 15 are respectively fastened to the axle 12 near its two distal ends and respectively stopped against the swing plates 31 to prohibit the axle 12 from axial or horizontal displacement and to keep the gears 14 in the respective arched adjustment slots 311. Further, a handwheel 16 is fastened to one end of the axle 12 for operation by the user to rotate the axle 12, causing the gears 14 to move the toothed portions 312 of the swing plates 31 along the curving direction of the arched adjustment slot 311. Each swing plate 31 further has an arched sliding slot 313 arranged in a parallel manner relative to the arched adjustment slot 311.

Each positioning device 40 comprises a positioning member 41 and a slide 42. The slide 42 is inserted into the arched sliding slot 313 of one of the swing plates 31 of the angle adjustment unit 30 and affixed to the associating mounting plate 11 of the housing 10 with fastening members, for example, screws 43. The positioning member 41 is disposed at an outer side relative to the slide 42. Further, each swing plate 31 of the angle adjustment unit 30 has a plurality of positioning holes 314 spaced above the arched sliding slot 313. Each positioning device 40 further comprises a locking device 44 mounted in the respective positioning member 41 for engaging into one of the positioning holes 314. The locking device 44 comprises a retractable locking pin 441 and a spring-loaded knob 442 mounted in the outer end of the retractable locking pin 441 and operable to move the retractable locking pin 441 into or out of one of the positioning holes 314. The locking device 44 is not limited to the aforesaid design, any other equivalent design can be used to lock the positioning member 41 to engage into one of the positioning holes 314, locking the respective swing plate 31 to the associating mounting plate 11 of the housing 10.

The operation and principle of the present invention will be outlined hereinafter with reference to FIGS. 4~6.

Figure 4:
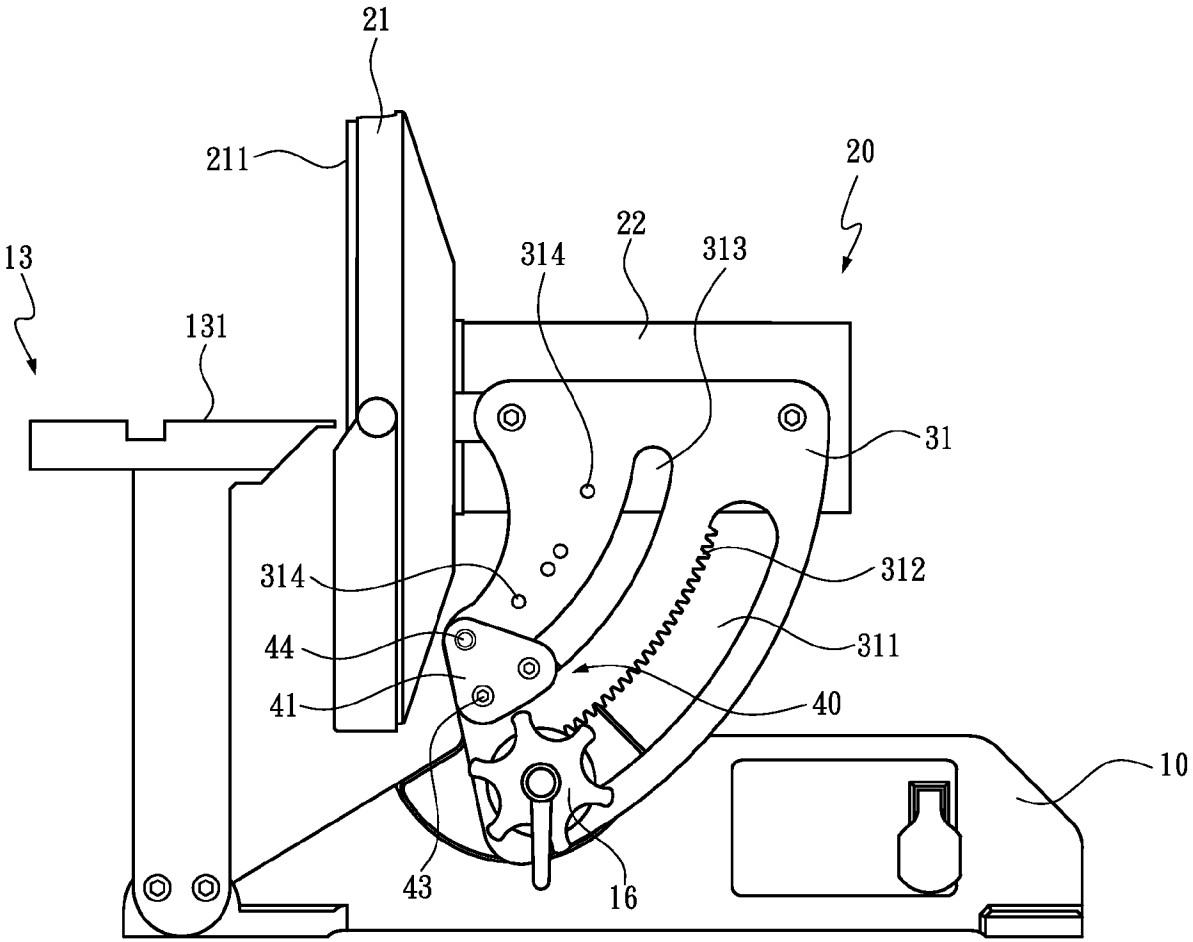
FIG. 4 is a side view of the disc sander in accordance with the present invention.
Figure 5:
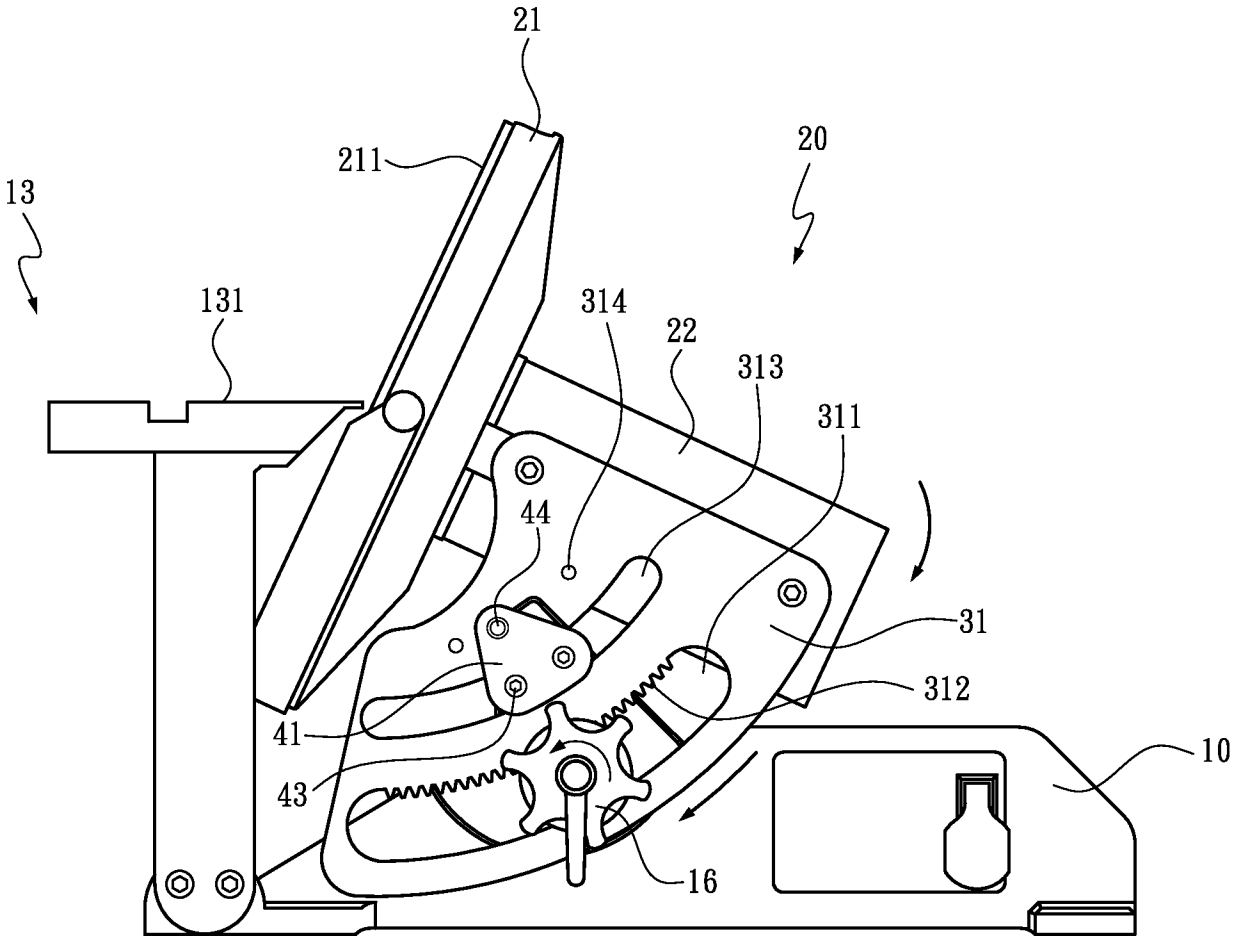
FIG. 5 is a schematic drawing of the present invention illustrating an adjustment of the angle between a work surface and a sanding surface (I)
Figure 6:
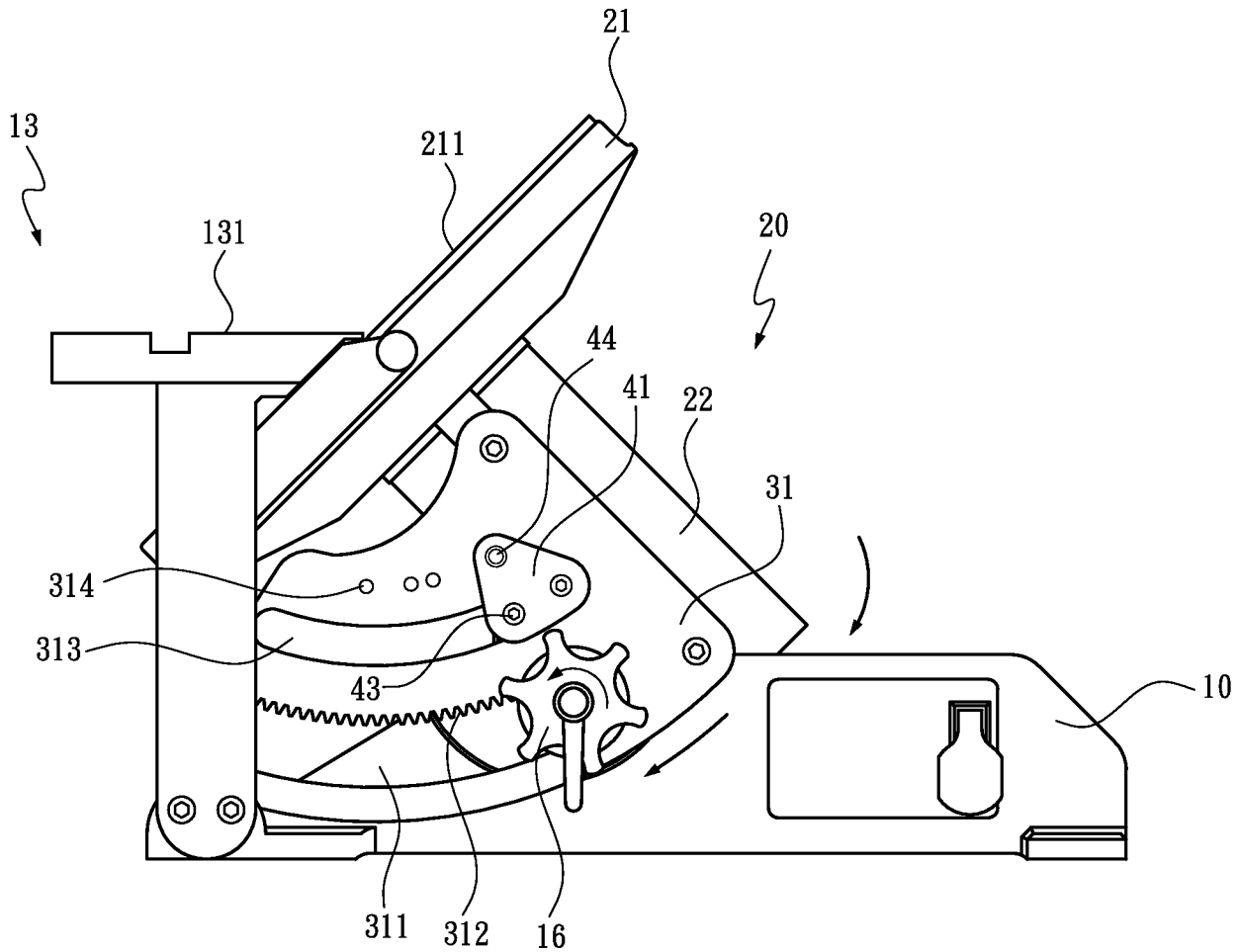
FIG. 6 is a schematic drawing of the present invention illustrating an adjustment of the angle between the work surface and the sanding surface (II).

As illustrated in FIGS. 4~6, when wishing to adjust the angle of the sanding surface 211 of the sand wheel 21 relative to the work surface 131 of the operation platform 13, pull the spring-loaded knob 442 of each locking device 44 to disengage the associating retractable locking pin 441 from the positioning holes 314 of the associating swing plate 31. At this time, operate the handwheel 16 to rotate the axle 12 and the gears 14, thereby biasing the swing plates 31. Thus, the sanding mechanism 20 is biased with the swing plates 31 relative to the operation platform 13 to adjust the angle between the sanding surface 211 and the work surface 131 subject to the angle of the workpiece to be polished. When biasing the swing plates 31, the arched sliding slot 313 of each swing plate 31 is moved relative to the respective slide 42. After adjustment to the desired angle, release the spring-loaded knob 442 of each locking device 44, enabling the associating retractable locking pin 441 to engage into one respective positioning hole 314 of the associating swing plate 31 and stopped against the associating mounting plate 11, and therefore the swing plates 31 are locked to the mounting plates 11 of the housing 10.

As the operation platform 13 is perpendicularly affixed to the housing 10, the angle between the sanding surface 211 and the work surface 131 can be conveniently adjusted simply by means of adjusting the swing angle of the sanding mechanism 20. When sanding the workpiece, the user simply needs to push the workpiece into contact with the sanding wheel 21 without worrying about sliding of the workpiece, and therefore the sanding operation is easy and labor-saving, and the sanding quality is well controlled.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A disc sander, comprising:

a housing having an operation platform, said operation platform having a work surface for holding a workpiece for sanding;

a sanding mechanism mounted on said housing, said sanding mechanism comprising a sanding surface for sanding the workpiece; and an angle adjustment unit set between said housing and said sanding mechanism, said angle adjustment unit comprising two swing plates disposed at two opposite lateral sides relative to said housing, each said swing plate having one end connected to said sanding mechanism so that said sanding mechanism is biasable with said swing plates relative to said housing to change the angle between said work surface and said sanding surface, wherein each said swing plate comprises an arched adjustment slot for the passing of said axle and a toothed portion extending along at least one of two opposite lateral sides of said arched adjustment slot, and further comprising an arched sliding slot disposed in a parallel manner relative to said arched adjustment slot, and a positioning device mounted in said arched sliding slot for controlling positioning of the associating swing plate relative to said housing.

2. The disc sander as claimed in claim 1, wherein said sanding mechanism comprises a bracket; said swing plates are affixed to said bracket and disposed at two opposite lateral sides relative to said housing.

3. The disc sander as claimed in claim 1, wherein said housing comprises two mounting plates symmetrically disposed at two opposite lateral sides thereof, each mounting plate having a through hole, and an axle fastened to the through hole of each said mounting plate for guiding biasing of said swing plates relative to said housing.

4. The disc sander as claimed in claim 3, wherein; said housing further comprises at least one gear mounted on said axle and meshed with at least one toothed portion of one said swing plate.

5. The disc sander as claimed in claim 4, wherein said axle is a noncircular rod member; each said gear has a noncircular center axle hole fitting the cross section of said axle.

6. The disc sander as claimed in claim 4, further comprising a handwheel mounted on one end of said axle and operable to rotate said axle.

7. The disc sander as claimed in claim 3, further comprising two stop members affixed to said axle near two distal ends of said axle and respectively stopped against said swing plates to prohibit said axle from axial displacement relative to said swing plates.

8. The disc sander as claimed in claim 1, wherein each said swing plate further comprises a plurality of positioning holes spaced above the arched sliding slot of the respective swinging plate; the positioning device in each said swing plate comprises a slide inserted into the arched sliding slot of the respective swing plate and affixed to one respective mounting plate at said housing with at least one fastening member, a positioning member disposed at an outer side relative to said slide, and a locking device mounted in said positioning member for selectively engaging into one said positioning hole.

9. The disc sander as claimed in claim 8, wherein each said locking device comprises a retractable locking pin for selectively engaging into one said positioning hole.

* * * * *